US005769267A

United States Patent [19]

Duynslager et al.

[11] Patent Number: 5,769,267

[45] Date of Patent: Jun. 23, 1998

[54] CONTAINER

[75] Inventors: Lieven Duynslager, Kortrijk; Paul Maes, Mortsel; Robert Scott, Niklaas, all of Belgium; Lieve Vanrusselt, Aberdeen, United Kingdom

[73] Assignee: Warner-Lambert Company, Morris Plains, N.J.

[21] Appl. No.: 556,058

[22] Filed: Nov. 9, 1995

[51] Int. Cl.[6] ..... A61J 3/07

[52] U.S. Cl. ..... 220/691; 220/4.21; 220/780

[58] Field of Search ..... 424/453, 454; 206/528, 530; 215/263, 321; 220/8, 691, 680, 4.21, 307, DIG. 34, 780, 785

[56] References Cited

U.S. PATENT DOCUMENTS

| | | | |
|---|---|---|---|
| 2,718,980 | 9/1955 | Strom | 220/8 |
| 3,399,803 | 9/1968 | Oglevee et al. | 220/DIG. 34 |
| 3,508,678 | 4/1970 | Graham et al. . | |
| 3,664,495 | 5/1972 | Graham et al. | 220/DIG. 34 |
| 3,823,843 | 7/1974 | Stephens et al. | 220/780 |
| 4,040,536 | 8/1977 | Schwarz | 206/530 |
| 4,487,327 | 12/1984 | Grayson | 206/530 |
| 4,534,467 | 8/1985 | Rathban | 206/528 |
| 4,792,451 | 12/1988 | Kim | 424/454 |

FOREIGN PATENT DOCUMENTS

| | | | |
|---|---|---|---|
| 3524963 | 1/1987 | Germany | 206/530 |

*Primary Examiner*—Stephen J. Castellano
*Attorney, Agent, or Firm*—Charles W. Almer

[57] ABSTRACT

A particular object of the invention is to provide a telescope-type capsule, e.g., for pharmaceutical use or the like, consisting of a cap and a body, the cap having four to six elongated, flat protrusions on its inner wall with a depth of from 30 to 100 $\mu$m, preferably 50 to 80 $\mu$m, and a length of 1.5 to 3 mm, and a narrowing positioned between the closed end and cylindrically shaped part of the capsule. The narrowing has an area with smaller inclination relative to the capsule axis and an area with stronger inclination which is disposed further away from the open end of the cap than the area with smaller inclination and has a width of 2 to 3 mm and an inclination of 0.03 to 0.07 mm/mm, preferably 0.04 to 0.06 mm/mm. A locking ring with a depth of from 30 to 160 $\mu$m, preferably 140 to 120 $\mu$m and a width of from 0.8 to 1.2 mm is provided on said narrowing. The body comprises likewise a locking ring, the counter locking ring, which matches the locking ring of the cap and has a depth of 25 to 70 $\mu$m and a width of 0.7 to 1.3 mm. Furthermore, at its open end the body is provided with an area of reduced diameter formed by a circular shaped ring with a depth of 10 to 60 $\mu$m and a width of 0.8 to 1.4 mm and a wider ring of symmetrical or asymmetrical cross-sectional profile to fit the elongated protrusions.

39 Claims, 3 Drawing Sheets

FIG-2 DISTRIBUTION OF PRELOCK FORCES
IMPROVED DESIGN
STANDARD DESIGN
SEPARATION PROBLEMS
S=8
S=4
LOOSE PIECES
FREQUENCY
0.1
0.09
0.08
0.07
0.06
0.05
0.04
0.03
0.02
0.01
0
0
5
10
15
20
25
30
35
40
45
50
PRELOCK FORCE

CONTAINER

FIELD OF THE INVENTION

The present invention relates to a container with telescope-type closure, e.g. a telescope-type capsule for pharmaceuticals, and in particular to a telescope-type closure with prelock and closure for fully closing the container.

BACKGROUND OF THE INVENTION

Standard containers for pharmaceuticals or other powdered, granular or liquid substances, so-called telescope-type capsules, consist of a tubular shaped or cylindrically shaped first part, namely the cap part which is closed on one end and open on the other end. A tightly fitting second part of similar shape, but of smaller diameter, can be telescopically inserted into said cap part, said second part being referred to as main part or body part. A separation of the first part from the second part after filling with a powder, e.g., a pharmaceutical, fertilizer or the like and final closure of the container parts is prevented by friction and/or various modifications of the surface of the capsule body and the opposed inner side of the cap part. For example, DE-A-1536219 shows one or more annular tapers of the body part near its open end which, when the capsule body and the cap are inserted into one another, are brought into engagement in corresponding tapers near the closed end of the cap to interlock the two parts.

Usually the containers are supplied to the filling apparatus in a "prelock" condition in which the body part is telescoped only partially into the cap. First the two parts are separated in the filling machine and then fully closed after the filling operation. The prior art has also provided measures to ensure the prelock. For example, DE-A-1812717 describes a capsule cap having near its open end inwardly disposed protrusions which are brought into engagement with the taper of the body to provide a readily releasable prelock.

The known capsule constructions, however, involve a number of disadvantages. In the case of powder filling, the closing forces can become very high due to the friction caused by powder entrapped between the body and cap during telescoping. This can cause the capsules to get damaged (so-called 'punched ends' form when the capsule film is punched at the edge due to too high forces exerted when the capsule parts are pushed into one another). Reducing the closing forces is therefore very beneficiary.

If the capsule parts rest too loosely on one another, they may separate, thus allowing the fill material to escape and rendering the capsule unusable. This may, for example, also occur in case hygroscopic material is filled in and the capsule shrinks in the course of time.

Moreover, it is problematic to suitably maintain the prelock condition. On the one hand, it is necessary for the capsule parts to be readily separable in the filling machine (low prelock force desired). On the other hand, the preclosed capsules must withstand the transport to the filling unit without separation of the capsule parts. This requires not only to set a specific prelock force, but also to keep the prelock force variation of individual capsules as low as possible.

Different measures have been applied in the prior art to improve the properties of such capsules.

Variants of the above-mentioned tapers to provide a closure for the capsule parts have been proposed. The configuration, dimension and arrangement of such tapers affect the capsule closing force and reopening force.

By airventing the capsule through an air channel reduces the risk of the capsule bursting open as a result of excess pressure caused during closing.

Various modifications of the above-described protrusions lead to a change in the prelock forces.

By changing certain production parameters, the capsule closing force and reopening force after filling can be influenced just as the prelock force.

Nevertheless, further research of the capsule design seems to be necessary for improving same to increase the resistance to reopening after filling and to the bursting as well as to reduce the closing forces, in particular with powder filling. Moreover, especially in view of the advanced, automatically operating filling machines in which occurring defects cannot be removed right away by an operator, a further improvement of the prelock properties appears to be necessary. Most of the existing prelock designs give too high prelock closing forces.

The following phenomenons can still be observed with currently known prelock and closure designs:

Most of the existing capsule designs show not enough resistance to bursting or show a gradual reduction of the reopening force in time due to film shrinkage or filling of hygroscopic powder.

Most of the existing capsule designs show too high closing forces with powder filling due to powder entrapped between cap and body.

A change of production parameters to modify closing and reopening forces involves unforseeable risks.

Airventing the capsules seems to help during the closing movement in the filling machine but is not enough to avoid bursting caused by excess pressure developed inside the capsule after filling.

Most of the existing prelock designs give too high opening forces and a too much variation which leads to "non-separation" or "loose pieces" (container halves).

A change of production parameters is risky and may cause unacceptable large variations between orders. Furthermore, most of the existing prelock designs are very sensitive to such manipulations so that small parameter changes can cause large changes in capsule behaviour.

The present invention is thus based on the object to overcome the above-mentioned disadvantages of known capsules and to provide a capsule which is improved in respect of the above-mentioned properties.

SUMMARY OF THE INVENTION

It is one object of the invention to provide a container of optimized design which guarantees increased protection against reopening and bursting. A further object of the invention is to provide a container of optimized design wherein the prelock forces are reduced and/or the prelock force variation of the container is reduced.

A further object of the invention is to provide a container of improved suitability for powder filling. According to a still further object, the invention relates to prelocked containers suitable for use in filling machines without involving loose container halves or containers with non-separable parts.

A particular object of the invention is the provision of a container which comprises a first part with at least a first connection unit and a second part with at least a second connection unit. The first connection unit comprises an elastic, hollow-cylindrical inner wall defining a substantially outer-cylindrically delimited cavity and an insertion axis, an open end, at least a first engagement area on the hollow-cylindrical inner wall and a narrowing which is positioned on the hollow-cylindrical inner wall between the open end and the first engagement area and narrows the cross-section defined by said hollow-cylindrical inner wall. The narrowing comprises at least two areas of different inclination with respect to said insertion axis, wherein the area with the strongest inclination with respect to said insertion axis adjoins said engagement area. The second connection unit of the second part comprises a cylindrically shaped outer wall which is insertable into the outer-cylindrically delimited cavity along the insertion axis through the open end and at least a second engagement area on the cylindrically shaped outer wall, the second engagement area being engageable with said first engagement area when the cylindrically shaped outer wall is inserted into said outer-cylindrically delimited cavity. Thereby, a permanent connection between said first part and said second part is provided.

A still further object of the invention is to provide a container similar to the one described above, but having at least a first prelock area on said hollow-cylindrical inner wall, said prelock area comprising several protrusions of elongated shape on said hollow-cylindrical inner wall, and at least a second prelock area on said cylindrically shaped outer wall, said second prelock area showing at least one indentation and being engageable with said first prelock area when said cylindrically shaped outer wall is inserted into said outer-cylindrically delimited cavity. Thereby, a releasable connection between the first part and the second part is provided.

A further object of the invention is to provide a container which combines the two above-mentioned aspects. According to this object, said first prelock area is located between said open end and said narrowing and, when the cylindrically shaped outer wall is inserted into said outer cylindrically delimited cavity, said releasable connection is formed first and, upon further insertion, said permanent connection is formed.

A particular object of the invention is to provide a telescope-type capsule, e.g., for pharmaceutical use or the like, consisting of a cap and a body, said cap having four to six elongated, flat protrusions on its inner wall with a depth of from 30 to 100 $\mu$m, preferably 50 to 80 $\mu$m, and a length of 1.5 to 3 mm, and a narrowing positioned between the closed end and cylindrically shaped part of the capsule. The narrowing has an area with smaller inclination relative to the capsule axis and an area with stronger inclination which is disposed further away from the open end of the cap than the area with smaller inclination and has a width of 2 to 3 mm and an inclination of 0.03 to 0.07 mm/mm, preferably 0.04 to 0.06 mm/mm. A locking ring with a depth of from 30 to 160 $\mu$m, preferably 140 to 120 $\mu$m and a width of from 0.8 to 1.2 mm is provided on said narrowing. The body comprises likewise a locking ring, the counter locking ring, which matches the locking ring of the cap and has a depth of 25 to 70 $\mu$m and a width of 0.7 to 1.3 mm. Furthermore, at its open end the body is provided with an area of reduced diameter formed by a circular shaped ring with a depth of 10 to 60 $\mu$m and a width of 0.8 to 1.4 mm and a wider ring of symmetrical or asymmetrical cross-sectional profile to fit the elongated protrusions.

DETAILED DESCRIPTION OF THE PREFERRED EMBODIMENTS

Figure 1:
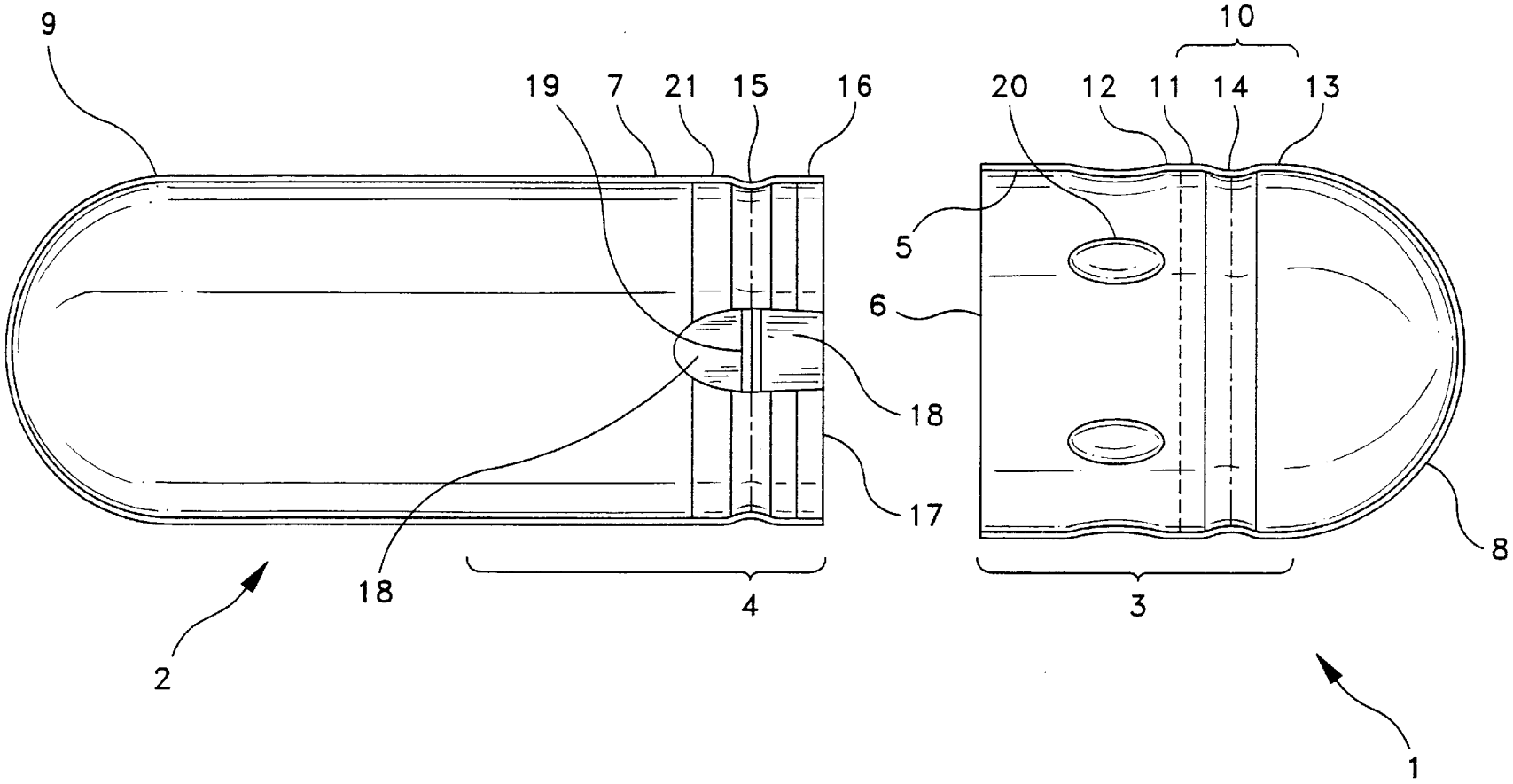
FIG. 1 shows a side view of a container according to one embodiment of the invention.

The container, for the purpose of description hereinafter referred to as capsule, consists of a first part, hereinafter referred to as "cap", and a second part, hereinafter referred to as "body". The inventors of the present invention have carried out numerous experiments to optimize the closing and prelock mechanisms of telescope-type capsules. In so doing, in part, features which are known in the art have been modified and, in part, new features have been introduced.

In so doing, first of all, different quantities which influence the behaviour of the capsules as well as the measuring methods to evaluate the same have been determined.

The SNAPFIT force is the force which is required to reseparate a particular filled and fully closed capsule into its capsule parts. This force is desired to be as high as possible to prevent an unauthorized opening of the capsules just as an undesired breaking loose, e.g., due to shrinkage.

The POP-APART force is the inner pressure of a particular capsule at which the latter bursts open. The measuring device produces a pressure and measures same in the interior of a capsules to be measured until the capsule bursts open.

The CLOSING force is the force which must be applied to a particular capsule to fully telescopically insert the capsule parts of a particular capsule into one another. The measuring device for determining this force imitates the closing action on the filling machine. By putting some powder at the body's open end, the closing force in the case of powder filling can be approached.

The PREFIT force is the force which is needed to open a prelocked capsule for filling. It should be of little variation. However, it must neither be too high (otherwise separation problems will arise in the filling station) nor too low (danger of the capsule parts falling apart during transport).

The LOOSE test defines the percentage of capsules whose halves have fallen apart during a specified time of tumbling in a mixer. This test can estimate the number of capsules falling apart during transport between production and the filling machine.

Subsequently, a number of capsule parameters were determined a change of which was believed to influence the above-mentioned quantities to be measured (see Table 1). Capsules were then produced in which a number of said parameters varied. Those parameters were chosen in each case which were assumed to affect a specific quantity. For reasons of simplicity, it was started out with two values for each parameter. For example, a quantity to be measured which is influenced, e.g., by three parameters, gave eight different possible capsule variants. These capsule variants were then tested for their behaviour in respect of the influenced quantity to be measured and evaluated in respect of the question which one of the two values of the parameters is the more favourable one for the desired behaviour.

This experimental approach thus made it possible for the first time to determine simultaneously the effects of different parameters on the capsule behaviour in contrast to former isolated assessments of individual parameters.

After the more favourable values had been specified in each case for the parameters under investigation, the parameters were varied in the subsequent test stages within the narrower limits of the previously determined values. Again in each case two values were selected for each parameter. In later test stages parameters were also combined which were assumed to affect different quantities to be measured to thus eventually arrive at a final test which contained all parameters still considered as relevant for the overall capsule behaviour with their previously determined optimal values. The result of these test series then led to the optimal capsule.

Table 1 shows by way of example a selection overview of the investigated capsule parameters. The column headed "Parameters" indicates the tested parameters. The column headed "Pair of dimensions" indicates the rough dimensions used in the first test stage. The column headed "Quantity to be measured" indicates the quantities which were assumed by the testers to be affected by a change in the parameter. The column headed "Result" shows that dimension of the pair of dimensions which was found to be the more favourable one in respect of the desired effect on the quantity to be measured, and under "final result" there is indicated the optimized result for a parameter established in subsequent test series. The indicated numerical values relate to the use of usual telescope-type capsules for pharmaceutical use. With other dimensions of the container of the invention for other applications, e.g., for packaging larger objects, the dimensions of the indicated parameters would have to be adapted accordingly.

The indicated numerical values moreover always relate to the dip pins used in production or, in case an injection molding process is applied for the container production, to the inner mold. As very thin walls are used for the telescope-type capsule exemplary shown in Table 1, the dimensions of the dip pins approach the dimensions of the capsules fabricated therewith.

TABLE 1

| Parameters | Pair of dimensions | Quantity to be measured | Result | Final Result |
|---|---|---|---|---|
| presence of a narrowing with stronger inclination | nor mal/increased narrowing | SNAPFIT force | increased nar-rowing | 2–3 mm wide; 0.03–0.07 mm/mm inclination |
| cap locking ring depth deep ring/flat | ring | SNAPFIT force | deep ring | 30–160 μm |
| cap locking ring width | wide/narrow ring | SNAPFIT force | narrow ring | 0.8–12 mm |
| matching lock-ing ring on body | matching ring/flat body | SNAPFIT force | matching ring | n.a. |
| CONI ring depth | flat/deep | CLOSING force | flat | 10–60 μm |
| CONI ring shape | circular/flat | CLOSING force | circular | n.a. |
| CONI ring width | narrow/wide | CLOSING force | | 0.8–1.4 mm |
| shape of locking ring | angular/circular | CLOSING force | circular | n.a. |
| airvent | present/absent | CLOSING force | present | n.a. |

TABLE 1-continued

| Parameters | Pair of dimensions | Quantity to be measured | Result | Final Result |
|---|---|---|---|---|
| play between cap and body | current/reduced | PREFIT force variation | reduced | 1.5–3 mm |
| protrusion length | shorter/longer | PREFIT force variation | longer | 5–20 μm |
| protrusion profile | flat/circular | PREFIT force variation | circular | n.a. |
| ring profile | asymmetric/ symmetric | PREFIT force variation | asymmetric | n.a. |
| ring depth flat/deep | PREFIT force variation | flat | | |
| protrusion depth | flat/deep | PREFIT force | any | 40–80 μm |

Table 1 is now explained in more detail with reference to FIG. 1. FIG. 1 shows—not true to scale—a lateral view of a telescope-type capsule optimized according to the invention as an example for a container. Reference number 1 designates the first part of the container, namely the cap. Reference number 2 designates the second part, namely the body or main part. Each on of said container parts comprises a cylindrically shaped portion which serve as connection units 3, 4, the cylindrically shaped portion 3 of the first part being a hollow cylinder comprising a cylindrically shaped inner wall 5 defining a substantially outer-cylindrically delimited cavity 6. By outer-cylindrically delimited is meant that a cavity is formed in the connection unit of the first part which is capable to receive a cylindrically shaped outer wall 7 of the connection unit 4 of the second part 2 when the two connection units 3, 4 are telescopically inserted into one another. The two connection units 3, 4 thus define with their cylindrically shaped walls sliding along one another an insertion axis along which telescoping is effected. The hollow-cylindrical inner wall 5 must be of specific elasticity which allows the latter to expand such as to permit passage of the cylindrically shaped outer wall 7 into the outer-cylindrically delimited cavity 6 also past the narrow wings of the inner wall 5 described below. In telescope-type capsules the cylindrically shaped connection unit is merely form, of a wall of substantially uniform thickness so that the capsule body 2 is of hollow cylindrical shape to receive substances. The cavity of the connection unit 4, however, can also have a different cross-section or can be completely filled out to serve, for example, as closure of a container 1 comprising a filling opening through the first connection unit 3.

The cylinders can be regular cylinders, but they can also have another shape, e.g., hexagonal or square shape, seen from above. The ends 8 and 9 of cap and body, respectively can have any shape, e.g., they may be hemispherical, flattened, box-shaped, of one piece or several pieces. As shown in the figure, they can be closed, or they can be open, e.g., in order to be extensible with a further closure system of the type of the invention or a different type.

A narrowed portion 10 in the hollow cylindrical portion consists of a narrowing 11 with stronger inclination, a "normal" narrowing 12 positioned further towards the open end of the first connection unit 3 and, optionally, of an enlargement area 13 positioned on the other side of the narrowing 11 with stronger inclination, said enlargement area 13 enlarging the diameter or the cross-sectional area of the hollow-cylindrical inner wall 5 again to substantially the same dimension as in front of the narrowing. Approximately in central position of the narrowing, between the narrowing 11 with stronger inclination and the enlargement area 13, there is provided a first engagement area 14 in the form of an annular bulging of the inner wall 5, referred to as the so-called locking ring. When the container is closed said locking ring 14 engages into its counterpart, a second engagement area 15 provided in the form of a counter locking ring recessed in the cylindrically shaped outer wall 7. If in telescope-type capsules, as depicted here, the engagement areas are preferably provided in the form of locking rings, it is also possible to use other closure mechanisms.

The so-called CONI ring 16 an endside, annular taper, preferably of circular cross-section, provided on the outer-cylindrical cavity wall of the second connection unit helps to facilitate and align the telescoping of cap and body after filling. An airvent 17 consists of indentation 18 to allow air passage when the two container parts are slid onto another and of an annular part 19 which corresponds in depth and profile to the counter locking ring 15 and constitutes a continuation of same in the airvent area.

The prelock mechanism of the container consists of protrusions 20 on the hollow-cylindrical inner wall 5 of the first connection unit 3, serving in the present case also as a first prelock unit, said protrusions 20 being capable of being slid on an indentation 21 provided as taper on the cylindrically shaped outer wall of the connection unit 4, serving in the present case also as second prelock unit to thus ensure the prelock position of the two container parts. Preferably, 4 to 6 protrusions 20 are provided around the circumference of the hollow-cylindrical inner wall 5. However, more or less protrusions may be present. When seen from above, the protrusions are of elongated shape, e.g., elliptical, the longitudinal axes of the ellipses being oriented parallel to the insertion axis.

The following parameters shown in Table 1 of the above-described capsule have been optimized within the scope of the present invention:

Presence of a narrowing 11 of stronger inclination in the narrowed portion 10

The tests which were carried out showed that the provision of an additional locking narrowing 11 with stronger inclination on the hollow-cylindrical inner wall of the first connection unit, as for example, the cap, increased the necessary SNAPFIT force as compared to the prior art comprising no narrowing 11 with stronger inclination. Preferably, the narrowed portion 10 is provided in the transition area between end 8, such as a hemispherical dome, and the first connection unit 3 of the container to allow the second connection unit 4 to be inserted as far as possible into the first connection unit 3 of the container, which advantageously renders mechanical locking of both container ends and thus unauthorized opening difficult if the invention is applied to a telescope-type capsule. Moreover, due to the increased overlap portion, sealing of the container is improved. The end 8 of the first part can thus consists of a continuous hemispherical end preceded by a narrowed portion 10. However, the narrowed portion 10 may also be provided in another portion of the hollow cylindrically shaped inner wall 5 of the first connection unit 3. The stronger inclined narrowing 11 may have an inclination with respect to the hollow-cylindrical inner wall 5 of 0.03 to 0.07 mm/mm (indentation divided by direction along the cylindrically shaped portion), preferably of 0.04 to 0.06 mm/mm. Its entire width may be in the range of 2 to 3 mm for usual telescope-type capsules. A 20 to 25% increase of the required SNAPFIT force can be obtained in this way.

Locking ring depth and width

Locking ring 14 formed in the hollow-cylindrical inner wall 5 was disposed in the centre of the narrowed portion 10. It was found that a narrow, deep ring 14 required comparatively higher SNAPFIT forces. A combination of both parameters in their advantageous forms gave an increase of 15 to 20%.

Matching counter locking ring 15

It was found here that, if the outer curvature of counter locking ring 15 was adapted to the inner curvature of locking ring 14 (each related to the container), a higher SNAPFIT force was obtained than with a flat cylindrically shaped outer wall 7 on which the locking ring 14 is held merely by friction. The SNAPFIT force could be increased by 30% as compared to this mere tension lock. In particular, such type of ring fit was found to be necessary for telescope-type capsules of the invention in order to maintain high SNAPFIT forces also over prolonged periods of storage. The position of the counter locking ring 15 on the cylindrically shaped outer wall 7 is dependent on the position of locking ring 14 as well as on the length of the connection units. When the capsule parts are fully telescoped, both rings must be in engagement with each other.

Depth, width and shape of CONI ring

It was assumed that these three parameters affect the required CLOSING force. It was found that a, when seen from the side, circular CONI ring with a width of 0.8 to 1.4 mm and a depth of 10 to 60 $\mu$m at its deepest point, preferably 10 to 46 $\mu$m (measured relative to the flat lateral wall of the body), may result into a reduction of the CLOSING force of up to 20%. The circular section is so oriented that its convex side is disposed outwardly. The convex side may also be disposed inwardly.

Locking ring shape

While an exact fit between locking ring 14 and counter locking ring 15 on the cylindrical portion influences the SNAPFIT force (see above), it was found that the actual shape of the two rings had an influence on the required CLOSING force. A configuration with, when seen from the side, circular rings gave a reduction of the required CLOSING force of 10% as compared to a configuration with, seen from the side, angular rings.

Airvent

It was found that the presence of an airvent 17 reduced the required CLOSING force. A subsequent optimization of various parameters of the airvent resulted into a 5% reduction of the CLOSING force with powder filling.

Play between cap and body

The distance between the hollow-cylindrical inner wall 5 and the cylindrically shaped outer wall 7 in closed position affects the required PREFIT force variation. It was unexpectedly found that a smaller distance between the walls reduced the PREFIT force variation. In particular, a distance in the range from 5 to 10 $\mu$m is preferred for usual telescope-type capsules.

Length of protrusions 20

The influence of the protrusion length (i.e., its dimension in longitudinal direction of the container) on the PREFIT force variation was determined. It was found in the experiments that a longer protrusion 20 resulted into a reduction of the PREFIT force variation. A protrusion length of 1.5 to 3 mm was found to be particularly advantageous for usual telescope-type capsules.

Protrusion profile

The shape of the protrusion surface (in cross-section) relative to the hollow-cylindrical inner wall 5 was varied. This parameter, too, was assumed to affect the PREFIT force variation. It was found in the experiments that protrusions 20 of circular cross-section resulted into a reduction of the PREFIT force variation as compared to flattened profiles, in which the surface of contact between protrusion 20 and cylindrical outer wall 7 is substantially linear and which consist of two inclined surfaces with opposite orientation and a surface therebetween which is oriented parallel to the cylindrical outer wall 7.

Holding ring profile

The profile of indentation 21 which is in contact with the protrusions 12 to ensure the prelock was likewise examined by way of example in the form of a holding ring, a taper on the cylindrically shaped outer wall 7. It was found that an asymmetric configuration of the cross-section of ring 15 contributes to a reduction in the PREFIT force variation as compared to a symmetric configuration. In lateral cross-sectional view, the asymmetric profile consists of an arcuate line whose angle of entrance into the cylindrically shaped outer wall 7 is unlike its angle of exit. In particular, asymmetric profiles are preferred wherein the entrance angle which is closer to that end of the second connection unit 4 which is first inserted into the outer-cylindrically delimited cavity 6 during closure is steeper than the entrance angle further remote from said end.

Holding ring depth

According to the inventors' examinations, the depth of holding ring 15 also influences the PREFIT force variation. It was found that a flat holding ring is favourable for a reduction of the variation as compared to a deeper ring.

Height of protrusions protruding from the hollow-cylindrical inner wall

The height of protrusions 20 is one of the parameters of the actual PREFIT force. It was found that it is obviously the main factor affecting the PREFIT force. Accordingly, the desired PREFIT force is readily achievable by a change of the protrusion height. In the present design, a reduction of the PREFIT force was desired. It showed that the PREFIT force could be reduced to 30% of the value of the prior art with telescope-type capsules with protrusion heights in the range of 40 to 80 $\mu$m, preferably 50 to 70 $\mu$m.

The thus obtained optimized parameters led to the optimize container in the form of a telescope-type capsule, for example. It should be understood that also individual optimized parameters result into the improved container shape according to the invention, and all combinations of different parameters likewise lead to improved container properties. Depending on the sensitivity of the filling process applied to disturbances and depending on the acceptable expense in terms of apparatus, one optimized parameter, a combination of several ones of the optimized parameter or even all optimized parameters may be used for the concrete design of an improved container, e.g., an improved telescope-type capsule. Furthermore, the "final results" eventually obtained according to the invention and likewise contained in Table 1 can be used for the design of a telescope-type capsule, as well as the rougher intermediate results of the initial optimization experiments which have already led to an improved capsule design as well, although this might be to a reduced extent.

The containers according to the invention can be produced by methods commonly applied for the production of telescope-type capsules, e.g., by means of dip molding processes with metal pins whose profiles have been made on the basis of the optimized parameters. The CONI ring, for example, can be produced as described in DE-A-2722806, herewith incorporated by reference. Equally, a production by means of injection molding is possible. While in the production of telescope-type capsules for pharmaceutical or comparable applications which make use of smaller container dip molding is currently preferred, it might be advantageous for the production of larger containers made of other materials to use injection molding or other suitable methods.

The containers according to the invention may be produced from various materials. For the production of smaller telescope-type capsules, the outer skin of which is to disintegrate, e.g., in the digestive tract or after they have been introduced into earth, gelatin, alginates, cellulose ester, methyl cellulose, cellulose ether ester, acrylic resins or substances having similar suitable properties can be used. Specifically, when injection molding methods are applied for the production of the capsules, use can be made also of starch. Various additives can be added, such as, e.g., glycerine, propylene glycol, monoacetin, diacetin and triacetin, glycol diacetate, polyols, such as sugar or polyvinyl alcohol, gelatin, hydrophilic polymers, vegetable proteins, water-soluble polysaccharides, such as, e.g., carrageenan or guar gum, blood proteins, egg proteins, acrylated proteins and others. Equally, dyestuffs and bactericides may be added to telescope-type capsules. In the production of containers of the invention for other purposes other materials can be used as well, such as, e.g., thermoplastic polymers.

The numerical values indicated for the optimized parameters relate to containers of the invention used as telescope-type capsules. In this type of application said parameters are practically independent of the capsule size and can thus be applied in capsules of all standard sizes, such as e.g., 000, 00, 0, 1, 2, 3, 4 or 5. For other applications of the container of the invention it might be necessary to adapt certain dimensions to obtain the desired optimizations of the container behaviour according to the invention.

A wide spectrum of filling substances is conceivable for the container of the invention. For example, powder, granulates, seeds, spices (herbs), fibers, liquids or solid bodies may be packaged.

The containers of the inventions exhibit the above-mentioned advantages. By applying all optimized parameters in the production of telescope-type capsules for the containers of the invention, an increase in the SNAPFIT forces of up to 40% as compared to current designs is obtainable, while the CLOSING force could be reduced by about 20 to 30% with powder filling.

In this respect, the experiments have shown that almost a linear correlation exists between the SNAPFIT force and the CLOSING force. An increased SNAPFIT force automatically leads to higher CLOSING forces.

If no reduction of the SNAPFIT force is desired or required, it can be maintained, which leads to a reduction of the CLOSING force by 20 to 30%, which can be very beneficiary in such cases. Therefore, the present invention relates of course also to designs in which only a reduction of the CLOSING force is decisive.

The telescope-type capsules of the invention may moreover exhibit a PREFIT force which is reduced to 40 to 50% of the current value. At the same time or independently thereof, the PREFIT force variation can be reduced to 40 to 50% of the current value.

Figure 2:
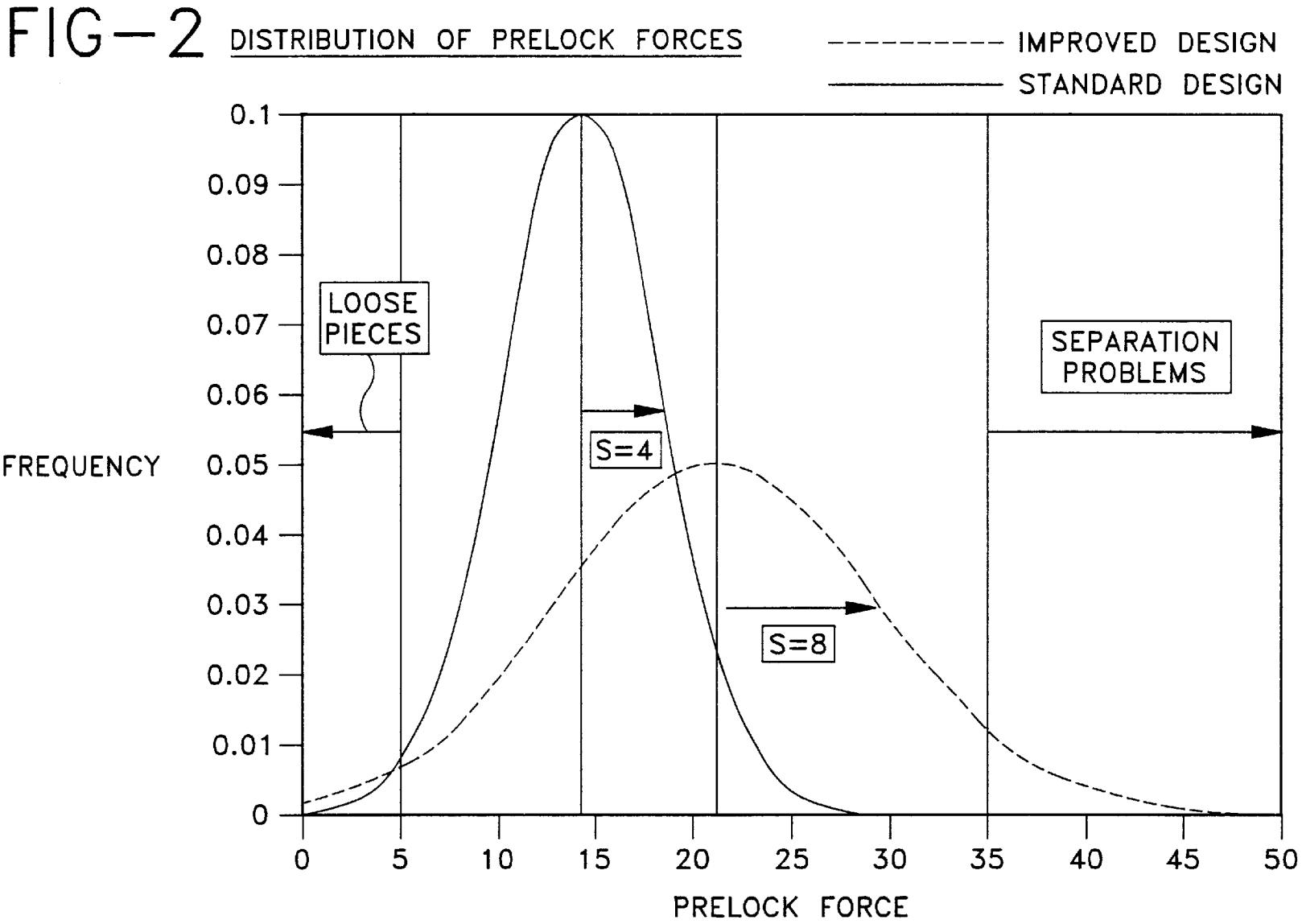
FIG. 2 shows a distribution of the required PREFIT forces for opening prelocked capsules with a capsule design according to the prior art and with the improved capsule design of the invention, the invention being applied to telescope-type capsules for, e.g., pharmaceutical use.

FIG. 2 shows a statistic distribution of the PREFIT forces to be applied for the opening of prelocked capsules. The chart clearly shows that capsules which have been made according to the prior art (dash line) not only show a higher average PRELOCK force clearly above 20 g) than the capsules of the invention (below 15 g, solid line), but also a show a considerably wider distribution dome. The greater variation width of the prior art capsules causes a considerable percentage of the capsules either separate during transport (below the limit value of 5 g PRELOCK force) or to be unseparable in the filling machine (above the limit value of 35 g). As against that, the percentage of loose capsules is significantly reduced in the production according to the invention and there a practically no separation problems any more.

Figure 3:
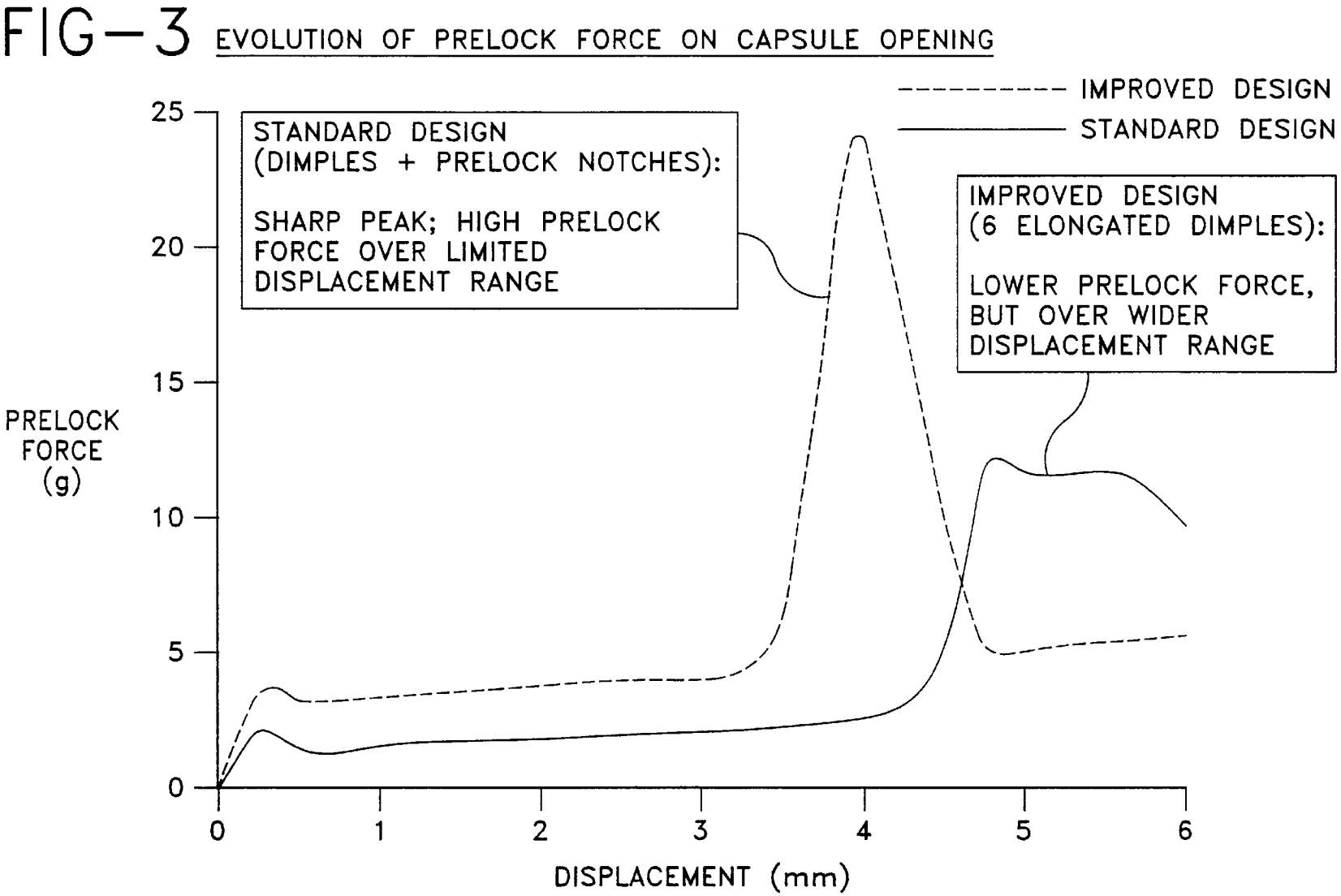
FIG. 3 shows the forces acting when the capsule parts of a prelocked capsule are pulled apart as a function of the displacement of the two capsule halves during pulling of a prior art capsule design and the improved capsule design of the invention, the invention being applied to telescope-type capsules for, e.g., pharmaceutical use.

FIG. 3 shows a linear force distribution which occurs if a single container, in the present case a telescope-type capsule, for example, is separated into cap and body in the filling station. The abscissa shows the displacement in mm of the two capsule parts as compared to their prelock position. The ordinate indicates in g the force acting at a specific displacement point on the capsule halves. Prior art capsules (dash line) show a sharp increase of the required force at 4 mm displacement which may result into separation problems. This is due the resistance which the protrusions of the known capsules must overcome when passing over the locking ring. As against that, the capsules of the invention (solid line) require less force. They show a peak which is considerable lower and is distributed over a wider range.

| | in g | | | |
|---|---|---|---|---|
| | According to the invention | | Prior Art | |
| | Average | Standard deviation | Average | Standard deviation |
| PREFIT force | 14.5 | 4.1 | 21.6 | 8.9 |
| CLOSING force | 852 | 64 | 641 | 68 |
| CLOSING force (lactose) | 1160 | 105 | 1231 | 205 |
| SNAPFIT force | 689 | 61 | 435 | 38 |
| SNAPFIT force (lactose) | 1022 | 124 | 397 | 85 |

Table 2 clearly shows the desired improvements in capsule behaviour which are achieved with the present invention. In particular, in lactose capsules the required SNAPFIT force could advantageously be increased to a considerable extent, while the standard deviation for the CLOSING force could be reduced to half.

We claim:

1. A container comprising (a) a first part with at least a first pre-connection unit, said first pre-connection unit comprising:

an elastic hollow-cylindrical inner wall defining a substantially outer-cylindrically delimited cavity and an insertion axis;

an open end;

at least a first prelock area on said hollow-cylindrical inner wall, said prelock area comprising several protrusions of elongated shape on said hollow-cylindrical inner wall; and (b) a second part with at least a second pre-connection unit, said second pre-connection unit comprising:

a cylindrically shaped outer wall which is insertable into said outer-cylindrically delimited cavity along said insertion axis through said open end; and at least a second prelock area on said cylindrically shaped outer wall, said second prelock area having at least one indentation and being engageable with said first prelock area when said cylindrically shaped outer wall is inserted in said outer-cylindrically delimited cavity, thereby providing a releasable connection between said first part and said second part; further comprising at least a first engagement area on the hollow-cylindrical inner wall; and at least a second engagement area on the cylindrically shaped outer wall which is engageable with said first engagement area when said cylindrically shaped outer wall is inserted into said outer-cylindrically delimited cavity, thereby providing a permanent connection between said first and said second part.

2. A container according to claim 1, wherein said protrusions are located from said open end at equal distance.

3. A container according to claim 1, wherein the longitudinal axes of said protrusions are substantially parallel to said insertion axis.

4. A container according to claim 1, wherein said hollow-cylindrical inner wall and said cylindrically shaped outer wall are regular cylinders.

5. A container according to claim 1, wherein said indentation on said cylindrically shaped outer wall is a recessed ring-shaped holding ring.

6. A container according to claim 5, wherein the width of said holding ring corresponds substantially to the length of said protrusions.

7. A container according to claim 5, wherein said holding ring has an asymmetric cross-section.

8. A container according to claim 5, wherein said holding ring shows a symmetrical cross-section.

9. A container according to claim 1 having 4 to 6 of said protrusions.

10. A container according to claim 1, wherein said protrusions have an elliptical shape when seen from above.

11. A container according to claim 1, wherein said protrusions have an elongated cross-section.

12. A container according to claim 11, wherein said container is a telescope-type capsule, said first part is a capsule cap, and said second part is a capsule body.

13. A container according to claim 12, wherein said protrusions have a length of from 1.5 to 3 mm.

14. A container according to claim 12, wherein said protrusions have a height of from 40 to 80 $\mu$m.

15. A container, comprising a first part with at least a first connection unit, said first connection unit comprising:

an elastic hollow-cylindrical inner wall defining a substantially outer-cylindrically delimited cavity and an insertion axis; an open end;

at least a first engagement area on the hollow-cylindrical inner wall;

a narrowed portion which is located between said open end and the first engagement area on the hollow-cylindrical inner wall, and which narrows the cross-section defined by said hollow-cylindrical inner wall, said narrowed portion comprising at least two areas of different inclination with respect to said insertion axis, wherein the area with the strongest inclination with respect to said insertion axis adjoining said engagement area; and at least a first prelock area on said hollow-cylindrical inner wall, said prelock area comprising several protrusions of elongated shape on said hollow-cylindrical inner wall, said first prelock area being located between said open end and said narrowed portion; a second part with at least a second connection unit, said second connection unit comprising:

cylindrically shaped outer wall which is insertable into said outer-cylindrically delimited cavity along said insertion axis through said open end;

at least a second engagement area on the cylindrically shaped outer wall, said second engagement area being engageable with said first engagement area when said cylindrically shaped outer wall is inserted in said outer cylindrically delimited cavity;

thereby providing a permanent connection between said first part and said second part; and at least a second prelock area on said cylindrically shaped outer wall, said second prelock area showing at least one indentation and being engageable with said first prelock area when said cylindrically shaped outer wall is inserted into said outer-cylindrically delimited cavity, thereby providing a releasable connection between said first and said second part, whereby, when the cylindrically shaped outer wall is inserted into said outer-cylindrically delimited cavity, said releasable connection is formed first and upon further insertion said permanent connection is formed.

16. A container according to claim 15, wherein said first engagement area is a ring-shaped, protruding locking ring on said hollow-cylindrical inner wall, and said second engagement area is a ring-shaped counter locking ring recessed in said cylindrically shaped outer wall.

17. A container according to claim 16, wherein said locking ring and said counter locking ring are formfitting.

18. A container according to claim 16, wherein said locking ring and said counter locking ring have a circular cross-section.

19. A container according to claim 15, comprising an enlargement area which is located on said hollow-cylindrical inner wall further away from said first engagement area than said open end, said enlargement area expanding the cross-section defined by said hollow-cylindrical inner wall.

20. A container according to claim 15, wherein said hollow-cylindrical inner wall and said cylindrically shaped outer wall are regular cylinders.

21. A container according to claim 15, wherein said area of strongest inclination of the narrowed portion has an inclination of from 0.03 to 0.07 mm depth per mm container length.

22. A container according to claim 15, wherein said cylindrically shaped outer wall has a ring-shaped taper of circular cross-section at the end which is inserted into the outer cylindrically delimited cavity.

23. A container according to claim 15, wherein said protrusions are located from said open end at equal distance.

24. A container according to claim 15, wherein the longitudinal axes of said protrusions are substantially parallel to said insertion axis.

25. A container according to claim 15, wherein said indentation on said cylindrically shaped outer wall is a recessed ring-shaped hobbed holding ring.

26. A container according to claim 25, wherein the width of said holding ring corresponds substantially to the length of said protrusions.

27. A container according to claim 25, wherein said holding ring has an asymmetrical cross-section.

28. A container according to claim 25, wherein said holding ring has a symmetrical cross-section.

29. A container according to claim 15, wherein 4 to 6 of said protrusions are provided.

30. A container according to claim 15, wherein said protrusions have an elliptical shape, when seen from above.

31. A container according to claim 15, wherein said protrusions have an elongated cross-section.

32. A container according to claim 15, wherein said container is a telescope-type capsule, said first part is a capsule cap, and said second part is a capsule body.

33. A container according to claim 32, wherein said area of strongest inclination of said narrowed portion has a width of 2 to 3 mm.

34. A container according to claim 32, wherein said protrusions have a length of from 1.5 to 3 mm.

35. A container according to claim 32, wherein said protrusions have a height of from 40 to 80 $\mu$m.

36. A container according to claim 32, wherein said first engagement area is a ring-shaped, protruding locking ring on said hollow-cylindrical inner wall of the first connection unit and has a depth of from 30 to 160 $\mu$m.

37. A container according to claim 32, wherein said first engagement area is a ring-shaped, protruding locking ring on said hollow-cylindrical inner wall of the first connection unit and has a width of from 0.8 to 1.2 $\mu$m.

38. A container according to claim 32, wherein said cylindrically shaped outer wall has a ring-shaped taper of circular cross-section at the end which is inserted into the outer cylindrically delimited cavity, said ring-shaped taper having a depth of from 10 to 60 $\mu$m.

39. A container according to claim 32, wherein said cylindrically shaped outer wall has a ring-shaped taper of circular cross-section at the end which is inserted into the outer cylindrically delimited cavity, said ring-shaped taper having a width of from 0.8 to 1.2 mm.

* * * * *